United States Patent [19]

Bakermans

[11] Patent Number: 4,874,338

[45] Date of Patent: Oct. 17, 1989

[54] RECEPTACLE BOX TERMINAL WITH IMPROVED CONTACT AREA

[75] Inventor: Johannes C. W. Bakermans, Harrisburg, Pa.

[73] Assignee: AMP Incorporated, Harrisburg, Pa.

[21] Appl. No.: 32,899

[22] Filed: Mar. 31, 1987

[51] Int. Cl.[4] ..... H01R 11/22

[52] U.S. Cl. ..... 439/851; 439/842; 439/856

[58] Field of Search ..... 439/819–821, 439/823, 825–828, 834, 839, 842, 845, 850–851, 856, 862, 861

[56] References Cited

U.S. PATENT DOCUMENTS

| | | | |
|---|---|---|---|
| 2,647,248 | 7/1953 | Ritter | 439/851 |
| 3,262,088 | 5/1964 | West | 339/258 |
| 3,538,491 | 11/1970 | Longenecker et al. | 339/256 |
| 3,539,965 | 11/1970 | Morehart et al. | 339/17 |
| 3,548,368 | 12/1970 | Teagno et al. | 439/826 |
| 3,663,931 | 5/1972 | Brown | 339/218 R |
| 3,786,401 | 1/1974 | Jones et al. | 439/851 |
| 3,815,081 | 6/1974 | Jones | 439/851 |
| 4,152,042 | 5/1979 | Ostapovitch | 339/258 R |
| 4,168,880 | 9/1979 | Tesch | 339/259 R |
| 4,298,242 | 11/1981 | McKee | 439/851 |
| 4,448,477 | 5/1984 | Gladd et al. | 339/258 R R |
| 4,550,972 | 11/1985 | Romak | 439/851 |
| 4,655,522 | 4/1987 | Beck, Jr. et al. | 439/851 |
| 4,681,393 | 7/1987 | Fukishima et al. | 439/851 |
| 4,687,278 | 8/1987 | Grabbe et al. | 439/842 |
| 4,720,277 | 1/1988 | Sakamoto | 439/842 |
| 4,722,704 | 2/1988 | VanDerStuyf et al. | 430/851 |

*Primary Examiner*—P. Austin Bradley
*Attorney, Agent, or Firm*—Bruce J. Wolstoncroft

[57] ABSTRACT

The invention is directed to a socket (2) having an improved contact area (24) which allows a pin (4) to be inserted therein at an improper orientation relative to the axis of the socket (2). Coined edges (28) of beams (16, 18) prevent the corners (32) of the pin (4) from contacting the beam (16, 18), thereby ensuring that electrical engagement is provided between the embossments (24) provided on the beam (16, 18) and the flat, highly finished surfaces (26) of the pin (4). The embossments (24) are configured to be easily reproducible and durable to last over many cycles. A lead in surface (44) provided on the embossments (24) prevents excessive wear on the embossments (24), as well as providing for easy insertion of the pin (4) into the socket (2).

10 Claims, 2 Drawing Sheets

RECEPTACLE BOX TERMINAL WITH IMPROVED CONTACT AREA

This is a continuation-in-part of application Ser. No. 891,709, filed on July 31, 1986, and now U.S. Pat. No. 4,687,278 which issued on Aug. 18, 1987.

FIELD OF THE INVENTION

This invention relates to a contact socket of the type which receives electrical contact pins therein. More particularly, the invention relates to a socket which has an improved contact area which allows for easy insertion, reliability over many cycles, and a positive electrical connection to be effected even when the contact pin at an improper orientation relative to the socket.

BACKGROUND OF THE INVENTION

A commonly used type of contact terminal comprises a stamped and formed conductive metal box-like socket. Contact terminals of this type are widely used, often in multicontact electrical connectors as well as in connectors containing only one or two terminals.

Contact sockets of this type must be dimensioned such that when the pin is inserted into the socket, a contact force will be exerted by the socket on the pin to form a stable electrical connection between the socket and the pin. However, problems have arisen with the sockets currently available, causing the electrical connection between the socket and the pin to be unreliable and unacceptable.

A major problem associated with the sockets concerns the nonuniformity of manufacture thereof. Generally, the contact areas of the sockets are in the shape of a curved beam. This shape has proven to be difficult to reproduce to the degree of accuracy required to ensure that a positive electrical connection is affected. Consequently, the shape of the contact area may vary from one socket to the next, as well as from one contact area to the next in the same socket. This nonuniformity can lead to many problems, such as excessive wear and poor electrical connection caused by the stubbing of the pin as insertion occurs. These problems, and others, result in the socket being unacceptable.

A second problem with the sockets currently available focuses on insertion problems. The contact areas of the sockets must be able to withstand a great deal of force as the entire contact force exerted on the pin is applied through the contact areas. This requires that the walls of each contact area be strong enough to support the force. However, another criteria of the contact area is that it be as small as possible to minimize the space required by the socket. This is particularly important in this age of miniaturization. Consequently, a balance must be struck in order to obtain the maximum benefits of strength and size. One solution is to provide the contact areas with relatively steep walls to meet the force and size requirements of the socket. Therefore, as insertion occurs, the pin will engage the steep walls, causing the entire insertion force to be abruptly transferred to the pin. The shape of the contact areas can vary greatly, with some surfaces of the contact areas being essentially perpendicular to the sides of the pin. The increase in the insertion force required to overcome this surface can cause the pin to exert harmful forces on an already weak contact area. Also, contact areas can be positioned within given tolerances from the axis of the socket, allowing one or more contact areas to be positioned closer to the axis than the others. Therefore, as the pin is inserted into the socket, the contact areas positioned closest the axis will be contacted first, causing the contact areas closest the axis to wear more readily than the contact areas further from the axis. Each of these problems, when taken alone, can cause harmful effects, however, when combined, serious problems are likely. The chance of stubbing the pin against the contact areas is greatly increased, thereby effectively increasing the insertion force of the pin into the socket. This results in harmful stresses being applied to an already imperfect or weakened contact area which can cause failure of that contact area after only a few cycles.

A third problem with the contact areas of the socket is noticeable when the pin is improperly inserted into the socket. In actual practice, improper orientation is a frequent occurrence. If the pin is inserted at an improper rotation relative to the axis of the socket, the corners of the pin will engage the edges of beams on which the contact areas are located. This is an unwanted result. The corners of the pin are not as highly finished as are the smooth, flat surfaces of the pin, and therefore, the corners are burred and fractured and are usually the location of pin holes in the plating which results in corrosion sites. Consequently, there is no guarantee that the corners will make electrical connection with the edges of the beam when the corners and the edges are engaged. This uncertainty is an unacceptable result for an occurrence which is so frequent.

As is evident, many problems exist with the pin sockets currently available. The present invention teaches of a socket which solves these problems and which ensures that a positive electrical connection will be affected each time the socket is used.

SUMMARY OF THE INVENTION

The present invention is directed to the achievement of an improved contact socket which has a localized high pressure-low insertion force contact area. The contact area has a lead-in surface to guide the pin to the proper position. The uniform contact area and the lead-in surface provided thereon ensures that a positive electrical connection is affected and maintained even after many cycles have occurred. Additionally, the edges of the beams adjacent the contact area of the socket are sloped such that if the pin is inserted at an improper rotation relative to the axis of the socket, the corners of the pin will not contact the edges of the beams.

The invention is directed to a contact socket for reception of a contact pin. The contact socket has end portions and an intermediate portion. The intermediate portion has a plurality of at least two beams which are integrally connected to the ends and are equally spaced around the axis of the socket so that at least a pair of diametrically opposed beams are provided. Each of the beams projects inward toward the axis of the socket such that a contact section is provided at an apex of each beam which is nearest the axis of the socket.

An embossment, sometimes referred to as a "hertz dot", is positioned on the apex of each beam. Each embossment projects inward, towards the axis of the socket. The maximum distance between the surface of the embossments is less than the diameter or thickness of the contact pin. Each opposed pair of beams has their embossments spaced a respective distance from the pin receiving ends.

Each embossment has a lead-in surface integral therewith. The lead-in surface cooperating with the pin to prevent the pin from harming the embossment as the pin is inserted into the socket. The lead-in surface has a contact point at an end thereof, the contact point may be work hardened in order to make it more wear resistant.

Each apex has edges which slope away from the embossment located thereon. Consequently, as a pin is inserted at an improper rotation relative to the socket, corners of the pin will not contact the edges of the apexes, thereby ensuring that electrical engagement will be provided between the embossments and the smooth, flat surfaces of the pin.

DETAILED DESCRIPTION OF THE INVENTION

A contact socket 2 in accordance with the invention is adapted to receive a contact pin 4 therein to form a disengageable electrical connection between conductors (not shown) secured to pin 4 and socket 2 respectively.

Figures 1, 3, 4:
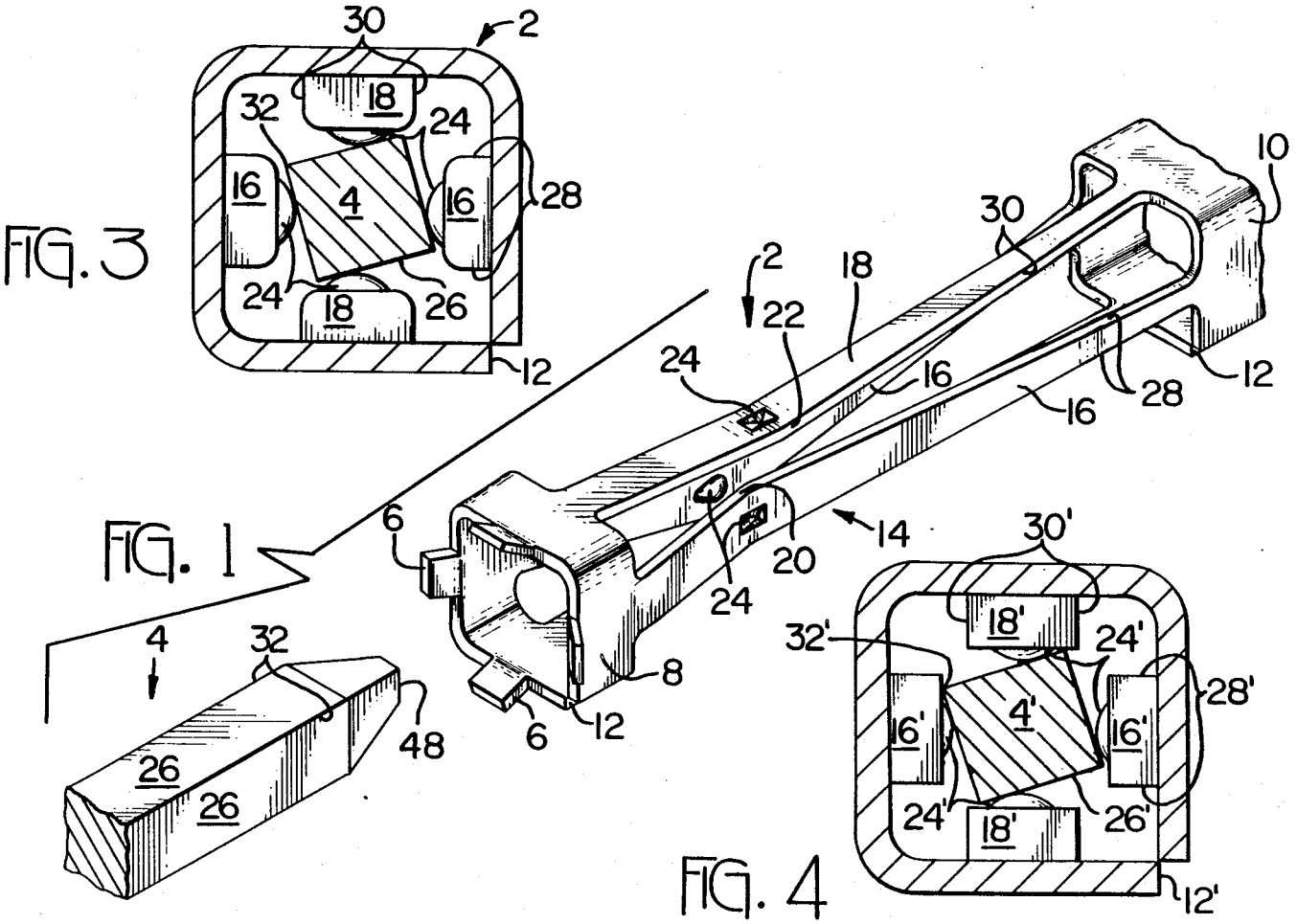
FIG. 1 is a perspective view of a contact socket in accordance with the invention showing part of a contact pin in alignment with the socket.
FIG. 3 is a cross sectional view taken along line 3—3 of FIG. 1, showing the pin inserted at a rotation with respect to the axis of the socket.
FIG. 4 is a cross sectional view of a prior art terminal, showing the pin inserted at a rotation with respect to the axis of the socket.

As shown in FIG. 1, socket 2 comprises a box-like receptacle portion having a square-shaped pin receiving end 8 and a square-shaped securing end 10. Pin receiving end 8 may have flared projection 6 as shown in FIG. 1 to guide pin 4 into socket 2. Socket 2 is stamped and formed from a flat blank such that seam 12 extends along pin receiving end 8 and securing end 10 in a corner of socket 2 as shown in FIGS. 1 and 3. End 8 and end 10 have essentially the same dimensions, the inside dimensions of which are greater than the dimensions of pin 8. Intermediate portion 14 of box-like socket 2 is composed of associated pairs of beams 16, 18 which extend axially and which have their ends fixed to the square-shaped ends 8, 10. The two beams of each pair 16, 18 are diametrically opposed to each other with respect to the axis of the receptacle portion and the beams are substantially identical to each other so that they will behave in a uniform manner when deflected.

Beams 16, 18 slope toward the axis of intermediate portion 14 such that apexes 20, 22 of beams 16, 18 define a smaller opening than do ends 8, 10. At the apexes 20, 22, each beam 16, 18 has a shallow "V" configuration with an embossment 24 positioned thereon to ensure a positive electrical connection with pin 4, as will be discussed. However, each opposing pair of beams 16 has their apexes 20 spaced from the apexes 22 of the other pair of beams 18 such that when pin 4 enters the intermediate portion 14, pin 4 will first encounter the apexes 20 of one pair of beams 16, after which the apexes 22 of the second pair of beams 18 will be encountered. This arrangement allows pin 4 to be inserted under reduced insertion force conditions. By staggering the apexes 20, 22 of the pairs of beams 16, 18, pin 4 must only force two beams 16 or 18 apart at one time. Once the beams 16, 18 are displaced, pin 4 encounters only frictional force from those beams. The frictional force is much less than the insertion force and, consequently, by staggering apexes 20, 22, pin 4 encounters the maximum forces from each pair of beams 16, 18 at different times, thereby reducing the force required to insert pin 4 into socket 2.

Figure 2B:
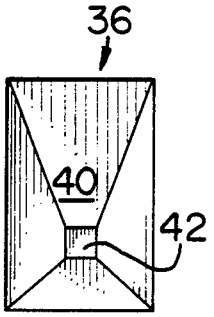
FIG. 2*b* is an enlarged fragmentary view showing a back surface of the embossment.
Figure 2A:
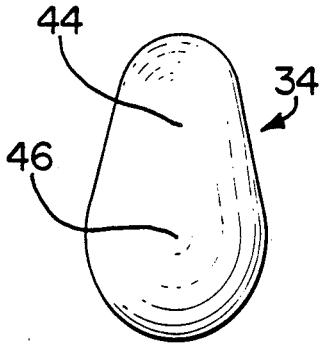
FIG. 2*a* is an enlarged fragmentary view showing a front surface of an embossment.

Apexes 20, 22 of beams 16, 18 are positioned substantially from the center of intermediate portion 14 as can be seen in FIGS. 1 and 2. This positioning ensures that pin 4 will contact apexes 20, 22 of beams 16, 18 early in the insertion process. Consequently, embossments 24 of apexes 20, 22 will contact pin 4 on sides 34 as compared to the pyramid-shaped bottom 36 where more imperfections occur, greatly enhancing the probability of making a positive electrical connection.

The reason for embossments 24 and the V-shaped configuration of beams 16, 18 is to localize the area of the contact between beams 16, 18 and a center section of the pin's flat sides 34. The electrical engagement, therefore, will occur away from edges 38 of pin 4, thereby minimizing the probability of pin holes present in the contact area and therefore, lessening the probability of corrosion occurring in this critical area.

However, to localize the area of contact between beams 16, 18 and the center section of sides 26, embossments 24 must be the only portion of beams 16, 18 which are in electrical engagement with pin 4. In order to insure that this occurs, edges 28, 30 of beams 16, 18 are coined at apexes 20, 22, as shown in FIG. 3. This provides apexes 20, 22 with surfaces which slope away from embossments 24. This allows socket 2 to accommodate pin 4 which has an improper rotation associated therewith. FIG. 3 shows pin 4, with an improper rotation inserted into socket 2 of the present invention. Although pin 4 is rotated relative to the axis of socket 2, corners 32 of pin 4 do not engage edges 28, 30 of beams 16, 18. Consequently, embossments 24 are maintained in electrical contact with sides 26 of pin 4, thereby ensuring that a positive, reliable electrical connection is affected. In contrast, FIG. 4 shows a pin 4', with an improper rotation, inserted into a commonly used socket 2'. As can be seen, corners 32' of pin 4' engage beams 16', 18' proximate edges 28', 30' of beam 16', 18', causing embossments 24' to not be in electrical engagement with pin 4'. This results in an ineffective and unreliable electrical connection, as was previously discussed.

Referring again to FIG. 3, the configuration of sockets 2 requires that embossments 24 be the only portion of beams 16, 18 which contact pin 4, as was discussed. Consequently, all the force exerted on pin 4 by socket 2 is done through embossments 24. The contact force must, as previously discussed, be maintained at a relatively high level to ensure that the electrical connection is maintained between pin 4 and socket 2, resulting in the need for embossments 24 to be able to withstand the relatively large force without failing.

In order to provide an embossment 24 which can withstand the contact force, previous sockets have had embossments which have been relatively large in comparison with the beams of the socket. The size of the embossments was required in order to obtain the strength characteristics required to maintain a strong, reliable electrical connection. However, as miniaturization occurs the need to conserve space becomes more important. The present invention is therefore directed to an embossment 24 which can be manufactured using a minimal amount of beam space, while allowing the embossment to withstand the pressure applied thereto by the insertion of pin 4 into socket 2. For example, embossments 24 may be 0.018 inches in length, 0.012 inches in width, and 0.003 inches in height. The embossments 24 also has the advantage of being able to withstand many cycles without failure due to excessive wear.

As shown in FIG. 2, embossment 24 has a front or contact surface 34 and a back surface 36. A punch is brought into engagement with back surface 36, as will be discussed. Back surface 36 is in the shape of a truncated pyramid with one wall 40 having a more gradual slope than the other walls. The pyramid shape back surface 26 of embossment 24 also has a flat top 42 provided thereon. As embossment 24 is formed, contact surface 34 is not formed in the shape of a pyramid with sharp edges, but rather in the shape of a tear drop with smooth corners. An elongated portion 44 of the tear drop is positioned opposite the more gradual sloping wall 40 of back surface 36. Elongated portion 44 acts as a lead-in surface for pin 4. A contact point 46 of contact surface 34 of the tear drop corresponds to the flattened top 42 of the pyramid shape of back surface 36.

This configuration of embossment 24 differs from that of the embossments of the prior art. This is attributed to the fact that the bottom wall and side walls of embossments 24 are produced at a relatively steep angle, thereby allowing the walls to be strong while not occupying much space. Top wall 44, however, is not manufactured at the same steep angle, instead it has a gradually sloping surface. Consequently, top wall 44 is longer than the bottom and the side walls, giving each embossment 24 the shape of a tear drop, as best shown in FIGS. 1 and 2.

Embossments 24 may have contact points 46 which are work hardened, thereby enabling contact points 46 to withstand many more cycles without failing. The manner in which this work hardening is performed will be more fully described below.

As was previously stated, the gradually sloping surface of top wall 44 is used as a lead-in surface. As pin 4 is inserted into socket 2 it moves through socket 2 under zero insertion force until a pyramid front 48 of pin 4 engages embossments 24 of beams 16, 18. As this occurs, pin 4 encounters the insertion force. As discussed above, embossments 24 of beams 16 are staggered with respect to embossments 24 of beams 18 to allow the insertion force to be reduced, eliminating the problems which may result if the entire insertion force must be overcome essentially at one time. Requiring the insertion force to be overcome at one time can cause an improper alignment of pin 4 in socket 2. Consequently, it is beneficial if the insertion force can be applied gradually to pin 4. Gradually sloping top wall 44 of each embossment 24 allows the insertion force to be applied gradually. As pin 4 is inserted into socket 2, the insertion force is transferred to pin 4 incrementally as pin 4 is slid smoothly over the gradually sloping surface of top wall 44.

Lead-in surface 44 is also important to prevent wear of embossments 24 during the numerous cycles to which socket 2 is exposed. In an ideal world, all beams 16, 18 would be spaced in exactly the correct position. However, this does not occur in the real world. Manufacturing tolerances allow beams 16, 18 to be spaced within a given range from the axis of socket 2. Consequently, beams 16, 18 will be positioned at varying distances from axis of socket 2. Therefore, as pin 4 is inserted into socket 2, pin 4 will engage embossment 24 of the beam which is positioned nearest the central axis of socket 2. This causes embossments 24 to wear unevenly, as the embossment closest to the axis will have more forces applied thereto as insertion occurs. Embossments 24 are usually covered with a thin layer of some noble metal to enhance the probability of making a positive electrical connection. Therefore, as insertion occurs, the beam closest to the axis of socket 2 will be engaged by pin 4 first. If embossment 24 does not have a gradual lead-in surface 44, the repeated engagement of pin 4 with embossment will cause pin 4 to wear through the noble metal, causing the electrical connection to be unreliable. However, with the gradual lead-in surface 44, as pin 4 engages embossment 24, pin 4 will be gently moved into contact with all embossments 24. This gradual movement reduces the wear on the noble metal, thereby increasing the effective life of socket 2.

Coined edges 28, 30, FIG. 3, are also desirable in real world situations, as there is a chance that pin 4 will be inserted at an improper angle of rotation, as shown in FIG. 3. This improper rotation of pin 4 can be accommodated by the configuration of beams 16, 18 of socket 2. The coining of edges 28, 30 allows pin 4 to be inserted at an improper rotation without causing harmful results. Edges 28, 30 of pin 4 will not contact coined edges 28, 30 of beams 16, 18 even when pins 4 are inserted at an improper orientation. This type of configuration insures that the area of contact between beams 16, 18 and pin 4 occurs where embossments 24 engage flat sides 26 of pin 4. This increases the reliability of the electrical connection between pin 4 and socket 2, because, as mentioned previously, sides 26 of pins 4 are where the least amount of imperfections occur.

An important advantage of the type of embossment described herein is its ease of manufacture and its ability to be effectively reproduced. In the market place today, it is important that a line of products be consistent, i.e. that one sample be identical to the next. This criteria has not been met by the sockets currently available. The prior art embossments, in the shape of partial spheres, have not been easily reproducible nor have they provided the required extra hard surface at the "hertz dot". These embossments have been manufactured using a punch and a die. The punch has its end configured in a partial spherical shape. The die, which is positioned on the opposite side of the material from the punch, has an opening which corresponds to the punch or a corresponding spherical shape. The beam is positioned on the die and the punch is brought down to make contact with the beam, forcing the beam to deform into the opening of the die. The surface of the beam which cooperates with the opening is the surface which makes contact with the pin. This process has proven to be very inadequate. The shape of the embossment had has a wide variety of shapes depending on each individual beam. In fact some embossments are formed having a nearly perpendicular side with respect to the beam. This type of inaccurate configuration results in the embossment developing failure after only one or two insertions. Also, the wear of the embossment is not proper, after only a few insertions, the layer of noble metal can be worn off.

Figure 5:
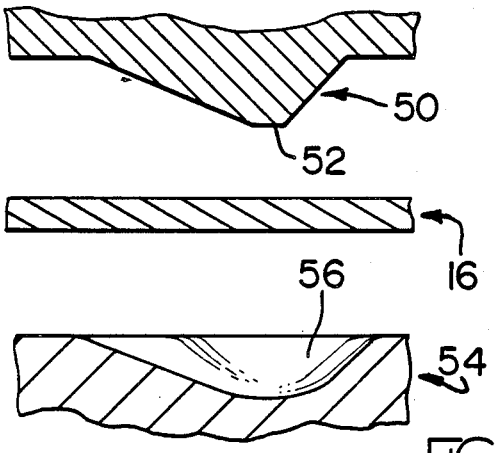
FIG. 5 is a cross sectional view showing the punch and die used to manufacture the embossments of the present invention.

These problems are solved with the current invention. The shape of embossments 24 allow for easy and effective reproduction. Punch 50 is ground into an offset pyramid shape with a flat top 52, as shown in FIG. 5. A cavity 56 of die 54 is manufactured into a tear drop shape. A respective beam is inserted between punch 50 and die 54. Punch 54 is forced into contact with the beam causing the beam to deform into cavity 56 of die 54. Embossment 24 is thus formed with a tear drop shaped outer surface and a offset pyramid inner surface, as was previously described. As both surfaces are controlled during the manufacturing process, the reproducibility of the tear drop embossment 24 is guaranteed. It should be noted that grinding punch 50 is a very simple and accurate way of obtaining the desired configuration. This allows contact point 46 of embossment 24 to be precisely located on each beam 16, 18. As each embossment 24 is essentially identical, contact point 46 can be accurately positioned in the same location on every embossment 24. The reliability of the electrical connection is therefore, greatly enhanced. The precision of reproducibility also provides socket 2 with a longer useful life. Embossments 24 are produced such that there will be no irregular surfaces. These smooth surfaces enable pin 4 to be inserted without causing embossments 24 to wear unevenly. Consequently, as repeated cycles take place, only normal wear of embossments 24 will occur, thereby increasing the effective life of socket 2.

Punch 50 and die 54 can be configured such that, as each beam 16, 18 is stamped, contact point 46 will be coined. Flat top 52 of punch 50, together with cavity 56 of die 54, cooperate with beams 16, 18 to ensure that contact points 46 will be work hardened as the stamping operation occurs. Consequently, work hardened contact point 46 will be more wear resistant, enabling contact point 46 to withstand many cycles without showing wear.

Contact sockets in accordance with the invention possess many desirable qualities of which smaller embossments, gradual insertion force, and a better contact surface are but a few. But perhaps the most beneficial aspect of this invention is that the pin may be improperly inserted into the socket without damaging the contact areas of the beams. Also, the pins may be inserted at an improper angle of rotation with respect to the axis of the socket and have the contact areas effect a proper electrical connection. Consequently, this socket is more practical for use in the field where precise alignment of the pin to the socket seldom, if ever, takes place.

I claim:

1. A contact socket for receiving a contact pin comprising:

a pin receiving end and an inner end, the inside dimensions of the ends being greater than the dimensions of the pin;

an intermediate portion between the pin receiving end and the inner end having an even number of at least two similar beams which are integrally attached to the pin receiving end as well as the inner end, the beams being equally spaced around the axis of the socket;

each of the beams projects inward toward the axis of the socket such that a contact section is provided at an apex of each beam which is nearest the axis of the socket;

an embossment positioned on the apex of each beam, each embossment projects inwardly towards the axis of the socket, the embossments on each pair of opposed beams being aligned with respect to the axis of the socket, the minimum distance between the surface of the embossments being less than the width of the contact pin;

the associated pairs of beams having their embossments spaced from the pin receiving end; and each embossment has a lead in surface integral therewith, the lead in surface cooperating with the pin to reduce the insertion force to prevent the pin from harming the embossment as the pin is inserted into the socket along the axis thereof.

2. A contact socket as recited in claim 1 wherein the contact sections have edges which slope away from the embossments located thereon, such that as a pin is inserted at an improper rotation relative to the socket, corners of the pin will not contact the edges of the apexes, thereby ensuring that electrical engagement will be provided between the embossments and smooth flat side surfaces of the pin.

3. A contact socket as recited in claim 1 wherein the pin receiving end has outwardly flared projections to guide the pin into the contact socket.

4. A contact socket as recited in claim 1 wherein the lead-in surface has a contact point at the end thereof, the contact point being work hardened to make the contact point more wear resistant.

5. A contact socket as recited in claim 1 wherein the embossments have a contact surface which is a tear drop configuration, the portion of which closest to the pin receiving end being the lead-in surface.

6. A contact socket as recited in claim 5 wherein the embossment has an inner surface, opposed the contact surface, which has an offset pyramid shape which corresponds to the surface of the punch used to form the embossment.

7. A contact socket as recited in claim 1 wherein the contact socket is in the shape of a box-like receptacle.

8. A contact socket as recited in claim 7 wherein the intermediae portion has pairs of essentially identical beams, each of which defines a respective side of the boxlike structure.

9. A contact socket as recited in claim 1 wherein the contact sections and embossments are positioned nearer the pin receiving end than the inner end, ensuring that the electrical contact between the embossments and the pin will occur on the sides of the pin, where better electrical contact is likely, this positioning also allowing a greater contact force to be applied on the pin by the beams.

10. A contact socket as recited in claim 9 wherein said at least two similar beams comprises at least a first pair of opposed beams and a second pair of opposed beams, said apex of each if said first pair of beams being closer to said pin receiving end than is said apex of each of said second pair of beams, whereby the insertion force is reduced as the pin is inserted into the socket.

* * * * *

UNITED STATES PATENT OFFICE

CERTIFICATE OF CORRECTION

Patent No. 4,874,338 Dated October 17, 1989

Inventor(s) Johannes C. W. Bakermans and Dimitry G. Grabbe

It is certified that error appears in the above-identified patent and that said Letters Patent is hereby corrected as shown below:

In claim 8, column 8, line 48, the word "intermediae" should be --intermediate--.

Signed and Sealed this

Thirtieth Day of October, 1990

*Attest:*

HARRY F. MANBECK, JR.

*Attesting Officer*

*Commissioner of Patents and Trademarks*